US007975674B2

(12) United States Patent
Kylström et al.

(10) Patent No.: US 7,975,674 B2
(45) Date of Patent: Jul. 12, 2011

(54) FUEL PUMP AND A METHOD FOR CONTROLLING A FUEL PUMP

(75) Inventors: Kim Kylström, Tullinge (SE); Tomas Flink, Huddinge (SE)

(73) Assignee: Scania CV AB (publ) (SE)

( * ) Notice: Subject to any disclaimer, the term of this patent is extended or adjusted under 35 U.S.C. 154(b) by 203 days.

(21) Appl. No.: 12/521,326

(22) PCT Filed: Dec. 13, 2007

(86) PCT No.: PCT/SE2007/050992

§ 371 (c)(1),
(2), (4) Date: Jul. 16, 2009

(87) PCT Pub. No.: WO2008/085098

PCT Pub. Date: Jul. 17, 2008

(65) Prior Publication Data

US 2010/0043759 A1 Feb. 25, 2010

(30) Foreign Application Priority Data

Jan. 8, 2007 (SE) ..... 0700023

(51) Int. Cl.
*F02M 37/04* (2006.01)

(52) U.S. Cl. ..... 123/495

(58) Field of Classification Search ..... 123/495, 123/497, 499

See application file for complete search history.

(56) References Cited

U.S. PATENT DOCUMENTS

| | | | | |
|---|---|---|---|---|
| 3,818,882 | A * | 6/1974 | Leonov et al. | 123/447 |
| 4,459,963 | A | 7/1984 | Gross et al. | |
| 5,404,855 | A | 4/1995 | Yen et al. | |
| 5,884,608 | A * | 3/1999 | Cooke | 123/495 |
| 5,937,826 | A * | 8/1999 | Olson et al. | 123/447 |
| 5,983,863 | A * | 11/1999 | Cavanagh et al. | 123/447 |
| 6,053,147 | A * | 4/2000 | Hemmerlein et al. | 123/447 |
| 6,076,504 | A * | 6/2000 | Stavnheim et al. | 123/447 |
| 6,439,193 | B2 * | 8/2002 | Lehtonen | 123/299 |
| 6,526,948 | B1 * | 3/2003 | Stavnheim et al. | 123/497 |
| 7,114,490 | B2 * | 10/2006 | Zdroik | 123/497 |

(Continued)

FOREIGN PATENT DOCUMENTS

EP 1 429 020 A1 6/2004

OTHER PUBLICATIONS

International Search Report dated Apr. 29, 2008, issued in corresponding international application No. PCT/SE2007/050992.

*Primary Examiner* — Hai H Huynh
(74) *Attorney, Agent, or Firm* — Ostrolenk Faber LLP

(57) ABSTRACT

A fuel pump and a method for controlling a fuel pump. At least two pumps run at a mutual phase displacement such that they are able to receive fuel during different periods of time. A control unit causes a valve, which is only settable in an open position and a closed position, to lead a desired amount of fuel to the respective pump. The control unit places the valve in the open position for a variable portion of the periods so that an individually controlled amount of fuel is led to the respective pump during those periods. Maintenance of good efficiency of the fuel pump and low noise emissions is thus made possible in operating situations where the fuel pump delivers a reduced amount of fuel.

21 Claims, 2 Drawing Sheets

U.S. PATENT DOCUMENTS 7,179,060 B2 * 2/2007 Sommars et al. ..... 417/53
7,415,972 B2 * 8/2008 Ogawa ..... 123/495
7,431,019 B2 * 10/2008 Kubota ..... 123/456
7,451,742 B2 * 11/2008 Gibson et al. ..... 123/446
7,517,200 B2 * 4/2009 Ferleyko et al. ..... 417/53
7,823,566 B2 * 11/2010 Fox et al. ..... 123/500
2006/0120880 A1 6/2006 Shafer et al.
2009/0138179 A1 * 5/2009 Felton ..... 701/103

* cited by examiner

FUEL PUMP AND A METHOD FOR CONTROLLING A FUEL PUMP

CROSS REFERENCE TO RELATED APPLICATION

The present application is a 35 U.S.C. §§371 national phase conversion of PCT/SE2007/050992, filed Dec. 13, 2007, which claims priority of Swedish Application No. 0700023-5, filed Jan. 8, 2007, the disclosure of which is incorporated by reference herein. The PCT International Application was published in the English language.

BACKGROUND TO THE INVENTION, AND STATE OF THE ART

The present invention relates to a fuel pump and to a method for controlling a fuel pump.

One way of reducing discharges of emissions from diesel engines is to inject the fuel at a very high pressure. A so-called "common rail" system is commonly used for effecting injection at a high pressure in the combustion spaces of a diesel engine. A common rail system comprises a high-pressure pump which pumps fuel at a high pressure to an accumulator tank ("common rail"). The fuel in the accumulator tank is intended to be distributed to all the cylinders of the combustion engine. Fuel from the accumulator tank is injected into the combustion spaces of the respective cylinders by electronically controlled injection means.

Conventional high-pressure pumps which deliver fuel to an accumulator tank usually comprise at least two pump means. The pump means work alternately so that when one pump means pressurises fuel, fuel is fed into the second pump means. The high-pressure pump can thus deliver a substantially continuous fuel flow at a high pressure to an accumulator tank. The fuel flow to the respective pump means is controlled by a regulating valve which has a variable constriction. Depending on the load on the combustion engine, the constriction of the regulating valve is varied so that the high-pressure pump delivers a desired amount of fuel to the accumulator tank. Since the pump means work at a relatively high frequency, it is not possible to reset the constriction of the regulating valve each time when fuel is supplied to the respective pump means. The regulating valve therefore delivers a substantially equal fuel flow to each pump means. In situations where the load on the combustion engine is low, a reduced amount of fuel is supplied to the respective pump means. Thus only a small proportion of the stroke length of the pistons of the respective pump means is usable for compressing the fuel. Consequently the fuel pump will work at reduced efficiency when the load upon it is low. Moreover, the pump means will emit more noise when the load upon them is low. The reason for the increased noise emissions is that the pump means are not totally full of fuel during the compression stroke of the pistons.

SUMMARY OF THE INVENTION

The object of the present invention is to provide a fuel pump and a method for controlling a fuel pump whereby fuel can with very good accuracy be delivered to the respective pump means of the fuel pump in a relatively simple manner. Other objects are that the fuel pump should have good efficiency and emit little noise substantially irrespective of the amount of fuel pressurised by the fuel pump.

The objects indicated above are achieved with the fuel pump of the kind mentioned in the introduction which has the features of the invention. On the basis inter alia of knowing the prevailing fuel pressure in a fuel source, a control unit can calculate how long the valve needs to be kept in the open position to allow a desired amount of fuel to be supplied to the respective pump means. Valves which are only settable in an open position and a closed position can usually be switched very quickly between said positions. Valve opening time can thus be controlled with good accuracy and hence also the amount of fuel which is supplied to the respective pump means. Such valve control thus allows individual control of the amount of fuel delivered each time to the respective pump means. The efficiency of a pump means and its noise emissions depend on the amount of fuel delivered to it. Such individual control of the amount of fuel delivered to the respective pump means allows the total amount of fuel to be distributed among the respective pump means in such a way that the fuel pump achieves overall a substantially optimum good efficiency and substantially optimum low noise emissions with the amount of fuel pressurised by the fuel pump.

According to an embodiment of the present invention, the control unit is adapted to controlling the valve so that it leads a maximum amount of fuel to one pump means and a remaining amount of fuel to the other pump means in operating situations where the fuel pump is adapted to delivering an amount of fuel which exceeds the capacity of one of the pump means. By filling at least one pump means completely with fuel and the other with a remaining amount of fuel, the fuel pump works overall at higher efficiency than if the two pump means are provided with equal distribution of fuel. Noise emissions from the fuel pump are also reduced by such distribution of the amount of fuel between the pump means as compared with equal distribution. With advantage, the control unit is adapted to controlling the valve so that it only leads fuel to one pump means in operating situations where the fuel pump is adapted to delivering an amount of fuel which corresponds to or is below the capacity of one of the pump means. One pump means is thus filled completely or partly with fuel, while no fuel is led to the other pump means. Here again the fuel pump will operate with higher efficiency and lower noise emissions than if the fuel was distributed equally between the pump means.

According to another embodiment of the present invention, the control unit is adapted to using knowledge of the performance of the respective pump means to opt to supply fuel primarily to the pump means which has the best performance. The pump means of a high-pressure pump are subject to severe stresses. The pump means are subject during operation to wear which progressively reduces their performance, but the wear of each pump means is individual, with the result that the performance of the pump means usually differs after a period of use. The service life of the fuel pump can be lengthened by using primarily the pump means which has the best performance, i.e. the least worn pump means. The control unit may accordingly be adapted to receiving information from a pressure sensor concerning the pressure imparted to the fuel by the respective pump means, and to supplying fuel primarily to the pump means which imparts the greatest pressure to the fuel. In situations where the fuel is supplied to an accumulator tank ("common rail"), the existing pressure sensor may here be used for determining the fuel pressure in the accumulator tank at the times when the respective pump means deliver pressurised fuel to the accumulator tank.

According to another embodiment of the present invention, the pump means are of substantially identical configuration and are run at a mutual phase displacement that enables them to pressurise fuel in their respective spaces during different periods of time. Using substantially identical pump means makes it possible for the fuel pump to pressurise fuel to a corresponding pressure and in a corresponding quantity irrespective of which pump means is used. Pump means pressurising fuel during different periods of time makes it possible for fuel from one pump means at a time to be led to, for example, an accumulator tank. With advantage, the pump means are operated at a mutual phase displacement of 180° C. in a work cycle of 360°. Thus one pump means pressurises fuel while at the same time the other pump means receives fuel. The fuel pump may of course comprise more than two pump means run at suitable phase displacements.

According to another embodiment of the present invention, said pressure-generating means is a piston. A piston which has a relatively small contact surface with the fuel in the respective spaces of the pump means can with advantage be used for creating very high fuel pressure in the spaces. Said fuel source preferably contains fuel at a substantially constant pressure, making it relatively easy for the control unit to calculate the time for which the valve needs to be placed in the open position to allow a desired amount of fuel to be supplied to a pump means. The valve may be a solenoid valve. Solenoid valves have the characteristic of being switchable very quickly between a closed position and an open position. It is nevertheless also possible to use other types of valves which are only settable in a closed position and an open position.

BRIEF DESCRIPTION OF THE DRAWINGS

A preferred embodiment of the invention is described below by way of example with reference to the attached drawings, in which.

DETAILED DESCRIPTION OF A PREFERRED EMBODIMENT OF THE INVENTION

Figure 1:
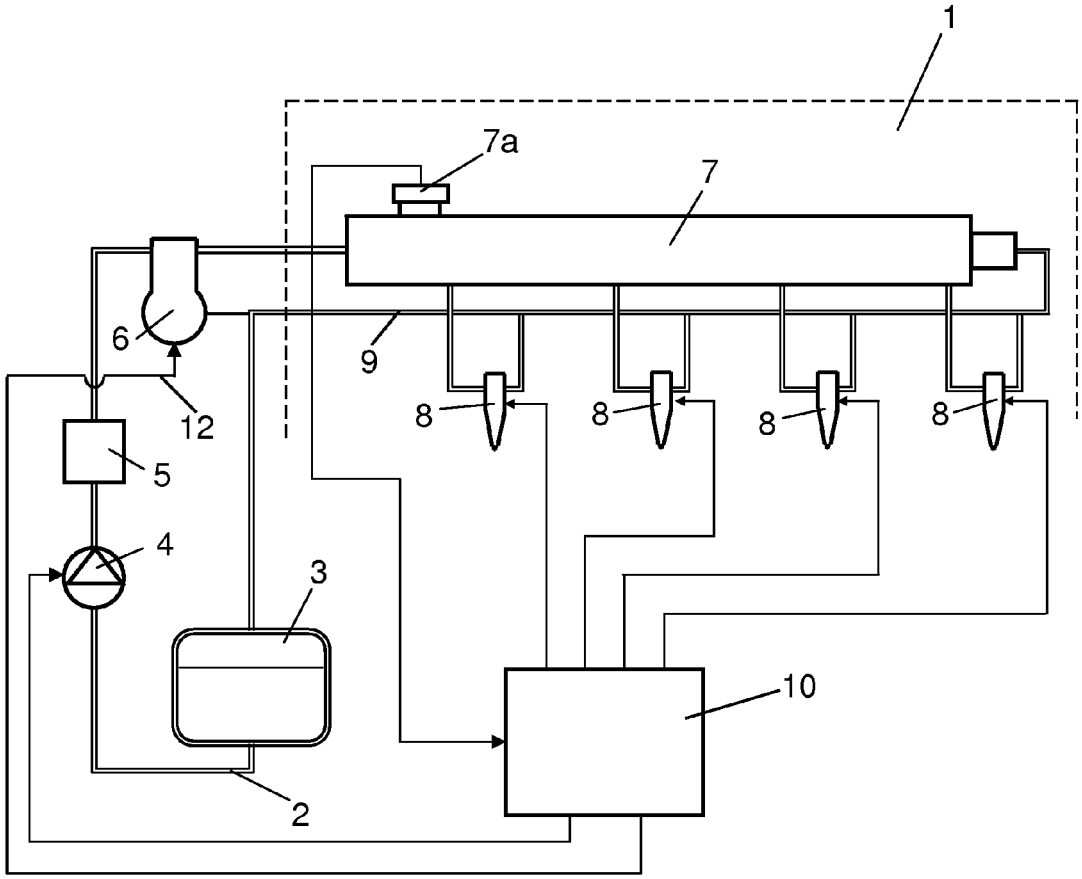
FIG. 1 depicts an injection system with a fuel pump according to the present invention and FIG. 2 depicts the fuel pump in FIG. 1 in more detail.

FIG. 1 depicts an injection system for injecting fuel at a very high pressure in a combustion engine here exemplified as a diesel engine 1. Injecting the fuel at a very high pressure may reduce discharges of emissions from the diesel engine 1. The injection system and the diesel engine 1 may be fitted in a heavy vehicle. The injection system comprises a fuel line 2 for supplying fuel from a fuel tank 3 to the respective cylinders of the diesel engine 1. A first fuel pump 4 is arranged in the fuel line 2 to transfer fuel from the fuel tank 3 to a second fuel pump in the form of a high-pressure pump 6 via a filter 5. The high-pressure pump 6 is adapted to pressurising the fuel so that it is fed at a high pressure into an accumulator tank 7 which takes the form of a so-called "common rail". Injection means 8 are arranged at each of the connections between the accumulator tank 7 and the respective cylinders of the diesel engine 1. A return line 9 is adapted to leading fuel not burnt in the diesel engine 1 back to the fuel tank 3. In cases where fuel is also used for controlling the opening times of the injection means 8, such a return flow may be relatively abundant. An electrical control unit 10 is intended to control the operation of the fuel pump 4, the high-pressure pump 6 and the injection means 8. The electrical control unit 10 may take the form of a computer unit provided with suitable software for effecting such control. A pressure sensor 7*a* is fitted in the accumulator tank 7 to detect the prevailing pressure therein and send to the control unit 10 a signal conveying information about pressure values detected. On the basis inter alia of that information the control unit 10 can control the injection means 8 so that they inject an optimum amount of fuel at an optimum time in the respective cylinders of the diesel engine 1.

Figure 2:
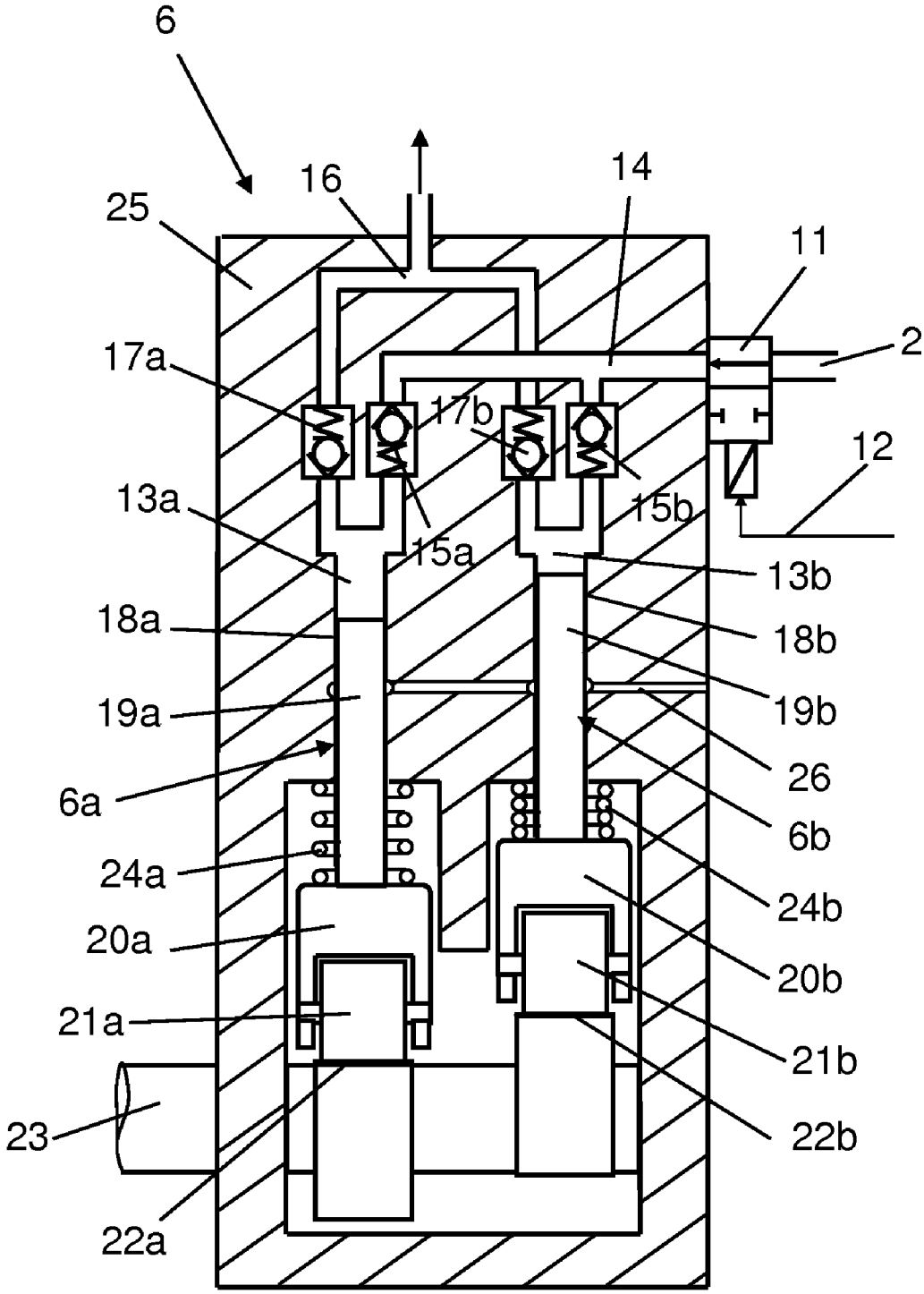

FIG. 2 depicts the high-pressure pump 6 in more detail. The high-pressure pump 6 comprises a first pump means 6*a* and a second pump means 6*b*. The pump means 6*a, b* are of substantially identical construction. The control unit 10 is intended to control a solenoid valve 11 by means of an electrical signal via a line 12 in order to regulate the supply of fuel from the fuel line 2 to the two pump means 6*a, b*. The solenoid valve 11 is only settable in an open position and a closed position. The pump means 6*a, b* each have their respective space 13*a, b* for receiving fuel. An inlet passage 14 is adapted to leading fuel from the solenoid valve 11 to the respective spaces 13*a, b* of the pump means. The inlet passage 14 is connected to the respective spaces 13*a, b* via inlet valves 15*a, b*. The inlet valves 15*a, b* are check valves adapted to opening when the fuel pressure in the inlet passage 14 exceeds the fuel pressure in the respective spaces 13*a, b*. An outlet passage 16 is adapted to leading pressurised fuel out from the respective spaces 13*a, b*. The outlet passage 16 is connected to the respective spaces 13*a, b* via outlet valves 17*a, b*. The outlet valves 17*a, b* are check valves adapted to opening when the fuel pressure in the respective spaces 13*a, b* exceeds a predetermined pressure $P_2$. The pressure delivered to the accumulator tank 7 will thus be at least the pressure $P_2$.

Each of the pump means 6*a, b* comprises a cylindrical space 18*a, b* with a movable piston 19*a, b*. The pistons 19*a, b* each have a pressure-generating surface which constitutes a delineating surface of the respective space 13*a, b*. The spaces 13*a, b* thus comprise a variable portion of the cylindrical spaces 18*a, b*, depending on the positions of the pistons 19*a, b* in the respective cylindrical spaces 18*a, b*. Each of the pistons 19*a, b* has a lower end which is in contact with a respective component 20*a, b* which comprises a rolling means 21*a, b*. The rolling means 21*a, b* is adapted to rolling along a respective cam surface 22*a, b* of a rotatable shaft 23. Spring means 24*a, b* are adapted to ensuring that the respective rolling means 21*a, b* are kept in continuous contact with their respective cam surface 22*a, b*. The cam surfaces 22*a, b* are of substantially identical shape but at a mutual displacement of 180°. Accordingly, the pistons 19*a, b* of the respective pump means 6*a, b* will move in opposite directions during operation of the shaft 23. A working cycle of the high-pressure fuel pump 6 may thus be divided into a first period of time and a second period of time. During the first period the piston 19*a* of the first pump means moves upwards so that fuel in the space 13*a* is pressurised while at the same time the piston 19*b* of the second pump means moves downwards so that fuel can be supplied to the space 13*b*. During the second period, the piston 19*a* of the first pump means moves downwards so that fuel can be supplied to the space 13*a* while at the same time the piston 19*b* of the second pump means moves upwards so that fuel in the space 13*b* is pressurised. The high-pressure pump 6 comprises a housing 25 which encloses the aforesaid components. The cylindrical spaces 18*a, b* comprise at one location a circular hollow space for intercepting any leaking fuel in the clearance between the pistons 19*a, b* and the cylindrical spaces 18*a, b*. The leaking fuel is led back to the fuel tank 3 via a line 26 and the return line 9.

During operation of the high-pressure pump 6, the control unit 10 receives information from various parameters related to the operation of the combustion engine 1. On the basis of that information and information from the pressure sensor 7*b* concerning the prevailing pressure in the accumulator tank 7, the control unit 10 calculates the total amount of fuel which the pump means 6*a, b* need to supply to the accumulator tank 7. The control unit 10 calculates thereafter the time for which the solenoid valve 11 needs to be kept in the open position for the respective pump means 6*a, b* so as to provide an optimum distribution of the total amount of fuel to the respective pump means 6*a, b*. When the solenoid valve 11 is open, fuel is led into the inlet passage 14 at a first pressure $P_1$ imparted to the fuel by the first fuel pump 4. The first pressure $P_1$ is higher than the pressure prevailing in the space 13*a, b* when the piston 19*a, b* moves downwards, and lower than the pressure $P_2$ which prevails in the space 13*a, b* when the piston 19*a, b* moves upwards. Thus the fuel in the inlet passage 14 can only be lead into one of the spaces 13*a, b* at a time. The fuel is thus led in the space 13*a, b* in which the piston 19*a, b* moves downwards. When thereafter this piston 19*a, b* turns and moves upwards, it pressurises the fuel in the space 13*a, b*. When the pressure in the space 13*a, b* reaches a predetermined value $P_2$, the outlet valve 17*a, b* opens. Fuel at least the pressure $P_2$ flows out from the space 13*a, b* and is led via the outlet passage 16 to the accumulator tank 7.

When the load on the combustion engine 1 is high, a substantially maximum amount of fuel needs to be supplied to the accumulator tank 7. In this situation the control unit 10 keeps the solenoid valve 11 open for a calculated time during said first period and said second period so that both of the spaces 13*a, b* of the respective pump means are filled with a maximum amount of fuel. In this operating situation, the resulting optimum use of the stroke lengths of the pistons 19*a, b* allows the fuel pump 6 to operate at high efficiency, and the fact that the spaces 13*a, b* are completely full of fuel during the stroke movements of the pistons 19*a, b* results in low noise emissions. In certain operating situations, however, the fuel pump 6 is adapted to delivering smaller amounts of fuel to the accumulator tank 7. When such a reduced amount of fuel exceeds the capacity of one pump means 6*a, b*, the control unit 10 causes the solenoid valve 11 to stay open long enough for a maximum amount of fuel to be led to one pump means 6*a, b*. The control unit 10 thereafter causes the solenoid valve 11 to stay open for a shorter time to enable a remaining amount of fuel to be led to the second pump means 6*a, b*. This method of filling one pump means 6*a, b* completely with fuel and the other pump means 6*a, b* with the remaining amount of fuel results in overall higher efficiency of the fuel pump 6 than if the two pump means 6*a, b* are filled equally with fuel. Noise emissions from the fuel pump 6 are also reduced by such distribution of the amount of fuel between the pump means 6*a, b* as compared with the fuel being distributed equally between the pump means 6*a, b*. In certain operating situations, the high-pressure pump 6 is adapted to delivering a small amount of fuel corresponding to or below the capacity of a single pump means 6*a, b*, in which case the control unit 10 is adapted to keeping the solenoid valve 11 in an open position long enough for said amount of fuel to be delivered to one of the pump means 6*a, b*. In this situation, the control unit 10 does not open the solenoid valve 11 at all during the period when the second pump means 6*a, b* might become filled with fuel. Here again, the high-pressure pump 6 runs at higher efficiency and emits less noise than if the fuel was distributed equally between the pump means 6*a, b*.

During operation, the pump means 6*a, b* inevitably undergo wear which progressively reduces their respective performance. The overall service life of the fuel pump 6 is lengthened by primarily using the pump means 6*a, b* which at the time has the best performance, i.e. the least worn pump means. The control unit 10 is adapted accordingly to receiving information from a pressure sensor 7*a* which detects the fuel pressure in the accumulator tank 7. Since the respective pump means 6*a, b* deliver pressurised fuel to the accumulator tank at different times, the control unit 10 can register the pressure which each pump means 6*a, b* is able to impart to the pressurised fuel in the accumulator tank 7. This pressure is a parameter related to the performance of the pump means 6*a, b*. On the basis of this information, the control unit 10 can primarily supply fuel to the pump means 6*a, b* which has the best performance in operating situations where the fuel pump 6 supplies a reduced amount of fuel. The result is optimum pressure in the accumulator tank 7 in such situations and longer service life for the high-pressure pump 6.

The invention is in no way limited to the embodiment described above but may be varied within the scopes of the claims. The high-pressure pump may comprise more than two pump means. The pump means may be operated at a suitable phase displacement so as to allow individual supply of fuel to the respective pump means.

The invention claimed is:

1. A fuel pump which comprises:

at least two pumps, each pump has a respective space configured for receiving fuel, the pumps are configured and operative to run at a mutual phase displacement with respect to each other such that they are able to receive fuel in their respective spaces during different respective periods of time, a valve connected to the pump spaces and being configured to be only settable in an open position or a closed position and being configured to regulate the amount of fuel led from a fuel source to each of the pump spaces, a respective pressure-generating device configured to pressurize the fuel in each of the spaces, a control unit configured and operative to control the valve such that a desired amount of fuel is led to the spaces of the pumps, the control unit being configured and operative to place the valve in the open position for a variable portion of the time periods for causing an individually controlled amount of fuel to be led from the fuel source to the spaces of the respective pumps during the time periods.

2. A fuel pump according to claim 1, wherein the pump spaces are configured to each receive up to a maximum amount of fuel, the control unit is configured and operative to cause the valve to lead a maximum amount of fuel to the space of a first one of the pumps and the remaining amount of fuel to the space of the other pump in operating situations where the fuel pump is operated to deliver an amount of fuel which exceeds the capacity of the first pump.

3. A fuel pump according to claim 2, wherein the control unit is configured and operative to cause the valve to lead fuel to only the space of the first pump in operating situations where the fuel pump is operated to deliver an amount of fuel which corresponds to or is below the capacity of the space of the first pump.

4. A fuel pump according to claim 3, wherein the control unit is configured and operative to use knowledge of a pumping performance of each of the pumps as a basis for supplying fuel primarily to the space of the pump which has the best performance based on the knowledge.

5. A fuel pump according to claim 4, further comprising a pressure sensor configured and operative for sensing pressure provided by the pumps, the control unit is configured and operative to receive information from the pressure sensor concerning the sensed pressure which corresponds to the pressure imparted to the fuel by each pump, and the control unit being configured and operative to cause the fuel pump to supply fuel primarily to the pump which imparts the greatest pressure to the fuel.

6. A fuel pump according to claim 1, wherein the pumps are of substantially identical configuration and are configured and operative such that the pumps are run at the mutual phase displacement for causing the pumps to pressurize fuel in their respective spaces during different periods of time.

7. A fuel pump according to claim 6, wherein the pumps are run at the mutual phase displacement of 180° in a working cycle of 360°.

8. A fuel pump according to claim 1, further comprising a respective pressure-generator in each space.

9. A fuel pump according to claim 8, wherein each pressure generator comprises a respective movable piston.

10. A fuel pump according to claim 1, wherein the fuel source contains fuel at a substantially constant pressure.

11. A fuel pump according to claim 1, wherein the valve is a solenoid valve.

12. A method for controlling a fuel pump, wherein the fuel pump comprises at least two pumps, each pump having a space for receiving fuel; a valve settable only in an open or a closed position and configured and operative to regulate the amount of fuel led from a fuel source to respective spaces of the pumps, a pressure-generator configured and operative to pressurize the fuel in the spaces, and a control unit configured and operative to control the valve such that a desired amount of fuel is led to the spaces of the pumps, the method comprising steps of operating the pumps at a mutual phase displacement such that the pumps receive fuel in their respective spaces during different periods of time, and placing the valve in the open position for a variable portion of the periods causing an individually controlled amount of fuel to be led from the fuel source to the spaces of the respective pumps during the periods.

13. A method according to claim 12, further comprising:

causing the valve to lead a maximum amount of fuel to a first one of the pumps and to lead the remaining amount of fuel to the other pump in operating situations where the fuel pump is configured and operable to deliver an amount of fuel which exceeds the capacity of the space of the first pump.

14. A method according to claim 13, further comprising:

causing the valve to lead fuel to only the first pump in operating situations where the fuel pump is configured and operable to deliver an amount of fuel which corresponds to or is below the capacity of the first pump.

15. A method according to claim 12, further comprising:

using knowledge of the pumping performance of each of the pumps as a basis for supplying fuel primarily to the pump which has the best performance.

16. A method according to claim 15, further comprising:

receiving information from a pressure sensor concerning the pressure imparted to the fuel by each pump, and supplying fuel primarily to the pump which imparts the greatest pressure to the fuel.

17. A method according to claim 12, further comprising:

providing pumps of substantially identical configuration, running the pumps at a mutual phase displacement such that they pressurize fuel in the respective spaces of the pumps during different periods of time.

18. A method according to claim 17, wherein the pumps are run at a mutual phase displacement of 180° in a working cycle of 360°.

19. A method according to claim 12, further comprising operating a respective piston for pressurizing the fuel in the spaces.

20. A method according to claim 12, further comprising using a fuel source to the fuel pump which contains fuel at a substantially constant pressure.

21. A method according to claim 12, further comprising using a solenoid valve for regulating the amount of fuel which is led from a fuel source to the spaces of the pumps.

* * * * *